US011959221B2

(12) United States Patent
Yoon et al.

(10) Patent No.: US 11,959,221 B2
(45) Date of Patent: Apr. 16, 2024

(54) LAUNDRY DRYER

(71) Applicant: LG Electronics Inc., Seoul (KR)

(72) Inventors: Juhan Yoon, Seoul (KR); Soowon Park, Seoul (KR); Manseok Lee, Seoul (KR); Jun Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 17/192,254

(22) Filed: Mar. 4, 2021

(65) Prior Publication Data

US 2021/0277582 A1 Sep. 9, 2021

(30) Foreign Application Priority Data

Mar. 4, 2020 (KR) ..... 10-2020-0027380

(51) Int. Cl.

| | |
|---|---|
| ***D06F 58/20*** | (2006.01) |
| ***D06F 34/14*** | (2020.01) |
| ***D06F 58/04*** | (2006.01) |
| ***D06F 103/62*** | (2020.01) |

(52) U.S. Cl.

CPC ..... *D06F 58/203* (2013.01); *D06F 34/14* (2020.02); *D06F 58/04* (2013.01); *D06F 2103/62* (2020.02)

(58) Field of Classification Search

CPC ..... D06F 58/04; D06F 58/2103; D06F 34/14; D06F 58/203

USPC ..... 34/90, 595–610

See application file for complete search history.

(56) References Cited

U.S. PATENT DOCUMENTS 3,677,039 A * 7/1972 Files ..... D06F 37/28 68/210
4,879,888 A * 11/1989 Suissa ..... D06F 43/08 68/18 F
5,827,329 A * 10/1998 Champeau ..... D06F 43/086 8/149.1

(Continued)

FOREIGN PATENT DOCUMENTS

CN 101180428 5/2008
CN 101466887 6/2009

(Continued)

OTHER PUBLICATIONS

Office Action in Chinese Appln. No. 202110238885.9, dated Nov. 11, 2022, 4 pages.

(Continued)

*Primary Examiner* — Stephen M Gravini
(74) *Attorney, Agent, or Firm* — Fish & Richardson P.C.

(57) ABSTRACT

A laundry dryer includes: a cabinet, a drum rotatably disposed inside the cabinet and configured to receive hot air and steam, a steam unit disposed inside the cabinet and configured to generate the steam, a storage tank configured to detachably couple to an inside of the cabinet and receive water to be supplied to the steam unit, a tank accommodating the storage tank, and a floater placed inside the storage tank and configured to move in a vertical direction according to a volume of water in the storage tank. The floater includes a body portion having a first outer surface and a second outer surface, a third outer surface and a fourth outer surface, and a fifth outer surface and a sixth outer surface, where the first outer surface defines an upper surface of the floater and the second outer surface defines a lower surface of the floater.

23 Claims, 10 Drawing Sheets

(56) References Cited

U.S. PATENT DOCUMENTS

| | | | | |
|---|---|---|---|---|
| 7,347,005 | B2 * | 3/2008 | Cerruti | A47L 15/486 34/235 |
| 7,921,578 | B2 * | 4/2011 | McAllister | D06F 35/00 34/597 |
| 7,934,278 | B2 * | 5/2011 | Oh | D06F 39/008 68/5 R |
| 8,468,718 | B2 * | 6/2013 | Favret | D06F 58/203 34/607 |
| 8,931,186 | B2 * | 1/2015 | Choi | D06F 58/30 34/443 |
| 10,816,266 | B2 * | 10/2020 | Welch | D06F 58/206 |
| 2007/0151311 | A1 * | 7/2007 | McAllister | D06F 39/088 68/3 R |
| 2021/0277582 | A1 * | 9/2021 | Yoon | D06F 34/14 |

FOREIGN PATENT DOCUMENTS

| | | | | |
|---|---|---|---|---|
| CN | 113355892 | A * | 9/2021 | D06F 34/14 |
| EP | 2145996 | | 1/2010 | |
| EP | 2818593 | | 12/2014 | |
| EP | 3875671 | A1 * | 9/2021 | D06F 58/203 |
| WO | WO2006126803 | | 11/2006 | |
| WO | WO 2008/075849 | | 6/2008 | |

OTHER PUBLICATIONS

EP Extended European Search Report in European Appln. No. 21159845.3, dated Jul. 16, 2021, 7 pages.
Office Action in European Appln. No. 21159845.3, mailed on Oct. 23, 2023, 5 pages.

* cited by examiner

LAUNDRY DRYER

CROSS-REFERENCE TO RELATED APPLICATION

This application claims the benefit of Korean Patent Application No. 10-2020-0027380, filed on Mar. 4, 2020, the disclosure of which is hereby incorporated by reference as if fully set forth herein.

TECHNICAL FIELD

The present invention relates to a laundry dryer, and more particularly, a laundry dryer capable of improving reliability and preventing delay in steam generation process by configuring a shape of a floater and a shape of a magnet embedded in the floater so that the floater can maintain a floating state even with an amount less than the minimum amount required for performing the steam process.

BACKGROUND

A laundry dryer removes the moisture from damp laundry to be dried by supplying hot air into a drum while the laundry to be dried such as clothes or bedding is put into a rotating drum.

The hot air supplied into the drum is generated by combustion heat using electric resistance heat or gaseous fuel, or by a condenser constituting a heat pump cycle, and the hot air thus generated is supplied to the inside of the drum by a circulation fan.

The moisture of the laundry to be dried is evaporated from the drum, and the air vented from the drum retains the moisture of the object to be dried, resulting in a high temperature and high humidity state. The type of dryer is classified into a condenser type and a vented type according to a method of treating the hot and humid air.

The condenser type laundry dryer does not discharge hot and humid air to an outside, but condenses the moisture contained in the hot and humid air through heat exchange while circulating inside the dryer. In contrast, the vented type laundry dryer directly discharges the hot and humid air to the outside. The condenser type laundry dryer has a structure for treating condensed water, and the vented type laundry dryer has a structure for venting air.

On the other hand, in recent years, in order to improve the drying efficiency of laundry, or for sterilization of laundry to be dried and sterilization of the drum itself, a laundry dryer having a means for spraying steam into the drum has been developed.

The steam jet type laundry dryer is configured to receive water for steam generation directly from an external water supply source or from a storage tank installed inside the laundry dryer.

In the case of using a storage tank to supply water to the steaming part, when the water stored in the storage tank is exhausted, a user separates the storage tank from the laundry dryer, recharges the water and installs the storage tank in the laundry dryer again. Accordingly, the water replenishment for the steam production is made.

In this regard, Korean Laid-Open Patent Publication No. 10-2016-0075031 discloses a clothes treatment apparatus which includes an internal water supply tank having a water storage space for steam generation and determines the remaining amount of water stored in the water supply tank through a floater floating along the water surface inside thereof.

The floater disclosed in the literature is provided with a magnet inside, and is configured to detect a change in a magnetic field according to the movement of a magnet and to determine the water level of the water supply tank and the remaining amount of water.

However, in the configuration disclosed in the literature, the vertical height of the floater moving upward and downward according to the change of the water level in the water supply tank is designed too large compared to the measurement section for determining whether there is insufficient water, and the height of the magnet installed inside the floater is designed too small compared to the vertical height of the floater. Thus, there is a case where a considerable amount of water is stored inside the water supply tank even though the floater is in the lowest position.

That is, since the floater is at the lowest position, the control unit receiving the position signal of the floater from the floater sensor determines that the amount of water in the water tank is insufficient, stops the steam generation process and generates a water shortage message to be delivered to a user.

However, the remaining amount of water actually stored in the water supply tank corresponds to the amount of water that can perform one or more cycle of the steam generation process. Accordingly, the user who has received a water shortage message despite the sufficient amount of water stored in the water supply tank can mistakenly perceive it as a failure of a product.

In addition, there is a problem that the operation of the entire device may be delayed due to an incorrect determination of water shortage.

On the other hand, in the configuration disclosed in the literature, a floater case for guiding the vertical movement of the floater is manufactured separately from the water supply tank and attached to the water supply tank.

Therefore, there are problems that the manufacturing process and manufacturing cost are remarkably increased due to the manufacture of the floater case itself and the assembly with the water supply tank.

(Patent document 0001) Korean Laid-Open Patent Publication No. 10-2016-0075031

SUMMARY

The present invention has been conceived to solve the above-described problems, and a first aspect of the present invention is directed to provide a laundry dryer capable of improving reliability and preventing delay in steam generation process by configuring a shape of a floater and a shape of an magnet embedded in the floater so that the floater can maintain a floating state even with an amount less than the minimum amount required for performing the steam process.

A second aspect of the present invention is directed to provide a laundry dryer capable of simplifying a manufacturing process of a storage tank and significantly reducing a manufacturing cost by integrally forming a floater case that guides the vertical movement of the floater in the storage tank.

A laundry dryer according to the present invention may include a cabinet forming an outer body, a drum rotatably supported inside the cabinet and supplied with hot air and steam therein, a steam unit placed inside the cabinet and to generate the steam, a storage tank placed inside the cabinet and to store water to be supplied to the steam unit therein, a tank housing placed inside the cabinet and to accommodate the storage tank and a floater placed inside the storage tank and to move in a vertical direction according to a level of water stored in the storage tank. The floater may include a body portion having a first outer surface and a second outer surface formed parallel to each other and spaced apart by a first interval, a third outer surface and a fourth outer surface formed parallel to each other and spaced apart by a second interval and a fifth outer surface and a sixth outer surface formed parallel to each other and spaced at a third interval. Inside the storage tank, the first outer surface may be placed to become an upper surface in the vertical direction and the second outer surface may be placed to become a lower side surface in the vertical direction, based on a state in which the storage tank is accommodated in the tank housing. The first interval may be smaller than the second interval or the third interval.

In addition, the third interval may be 8 to 10 times larger than the first interval.

In addition, the second interval may be 1.5 to 2.5 times larger than the first interval.

In addition, the floater may further include a magnet in a hexahedral shape embedded in the body portion, and the body portion may include a magnet receiving unit having a shape corresponding to the shape of the magnet and in which the magnet is inserted.

In addition, a height of the magnet in the vertical direction may be 0.5 to 0.8 times the first interval.

In addition, the floater may further include a pair of through holes each extending from the first outer surface to the second outer surfaces in the vertical direction.

In addition, the magnet may be placed between the pair of through holes.

In addition, the pair of through holes may include a first through hole formed close to the fifth outer surface, and a second through hole formed close to the sixth outer surface. A distance from a center of the first through hole to the magnet and a distance from a center of the second through hole to the magnet may be equal to each other.

In addition, a distance from the fifth outer surface to the center of the first through hole and a distance from the sixth outer surface to the center of the second through hole may be equal to each other.

In addition, the floater may further include a plurality of internal ribs in a linear shape protruding from an inner circumferential surface of each of the pair of through holes and extending in a direction from the first outer surface toward the second outer surface.

In addition, each of the plurality of internal ribs may have the same shape, and each may be spaced apart at a same interval.

In addition, the storage tank may include a box-shaped tank body with an open upper surface and to include a storage space for storing the water formed therein and a tank cover coupled to the open upper surface of the tank body. The tank body may include a pair of guide bars formed to protrude from the lower side surface of the tank body and extending in the vertical direction through each of the pair of through holes.

In addition, the tank body may further include a floater case protruding from the lower side surface of the tank body in a U-shape to surround the floater.

In addition, the floater case may include a main plate in a plate shape formed toward one side surface of the box-shaped tank body, a first subplate in a plate shape integrally formed on a front end of the main plate and formed toward a front surface of the box-shaped tank body and a second subplate in a plate shape integrally formed on the other rear end of the main plate and formed toward a rear surface of the box-shaped tank body. The floater may move in the vertical direction within an accommodation space defined as the main plate, the first subplate, the second subplate and the one side surface of the tank body.

In addition, the first subplate and the second subplate may be respectively spaced apart from the one side surface of the tank body at a predetermined interval.

In addition, the tank body may further include, in the accommodation space, a plurality of bottom ribs extending in a linear shape in a direction parallel to the lower side surface of the tank body and protruding from the lower side surface of the tank body.

In addition, the floater may further include a plurality of outer ribs protruding and extending in a linear shape along a direction parallel to the first outer surface and the second outer surface, respectively, and protruding from the first and second outer surfaces, respectively. The plurality of outer ribs may extend in a direction intersecting a direction in which the plurality of bottom ribs extends.

In addition, the tank cover may include a stopper in a columnar shape having one end fixed to the lower side surface of the tank cover, and the other end extending toward the first outer surface of the floater. The floater may be stopped when the other end of the stopper comes into contact with the first outer surface.

In addition, a height from the lower side surface of the tank body to the other end of the stopper may be shorter than a height at which the pair of guide bars protrudes from the lower side surface of the tank body.

In addition, the main plate, the first subplate and the second subplate may be formed to protrude to the same height from the lower side surface of the tank body, respectively. The height from the lower side surface of the tank body to the other end of the stopper may be shorter than the heights of the main plate, the first subplate or the second subplate.

In addition, a height from the lower side surface of the tank body to the other end of the stopper may be 2.5 to 3.5 times greater than the first interval.

In addition, the laundry dryer may further include a floater sensor installed in the tank housing and detecting a vertical position of the magnet embedded in the floater. The floater sensor may include a sensing unit extending in the vertical direction between a lowest position and a highest position of the magnet.

In addition, the floater sensor may be installed on the outer surface of the tank housing, and the sensing unit may be placed at a position on the outer surface of the tank housing closest to the magnet.

The laundry dryer according to the present invention can improve reliability and prevent delay in steam generation process by configuring a shape of a floater and a shape of an magnet embedded in the floater so that the floater can maintain a floating state even with an amount less than the minimum amount required for performing the steam process.

In addition, the laundry dryer according to the present invention can simplify a manufacturing process of a storage tank and significantly reduce a manufacturing cost by integrally forming a floater case that guides the vertical movement of the floater in the storage tank.

DETAILED DESCRIPTION

Figure 1:
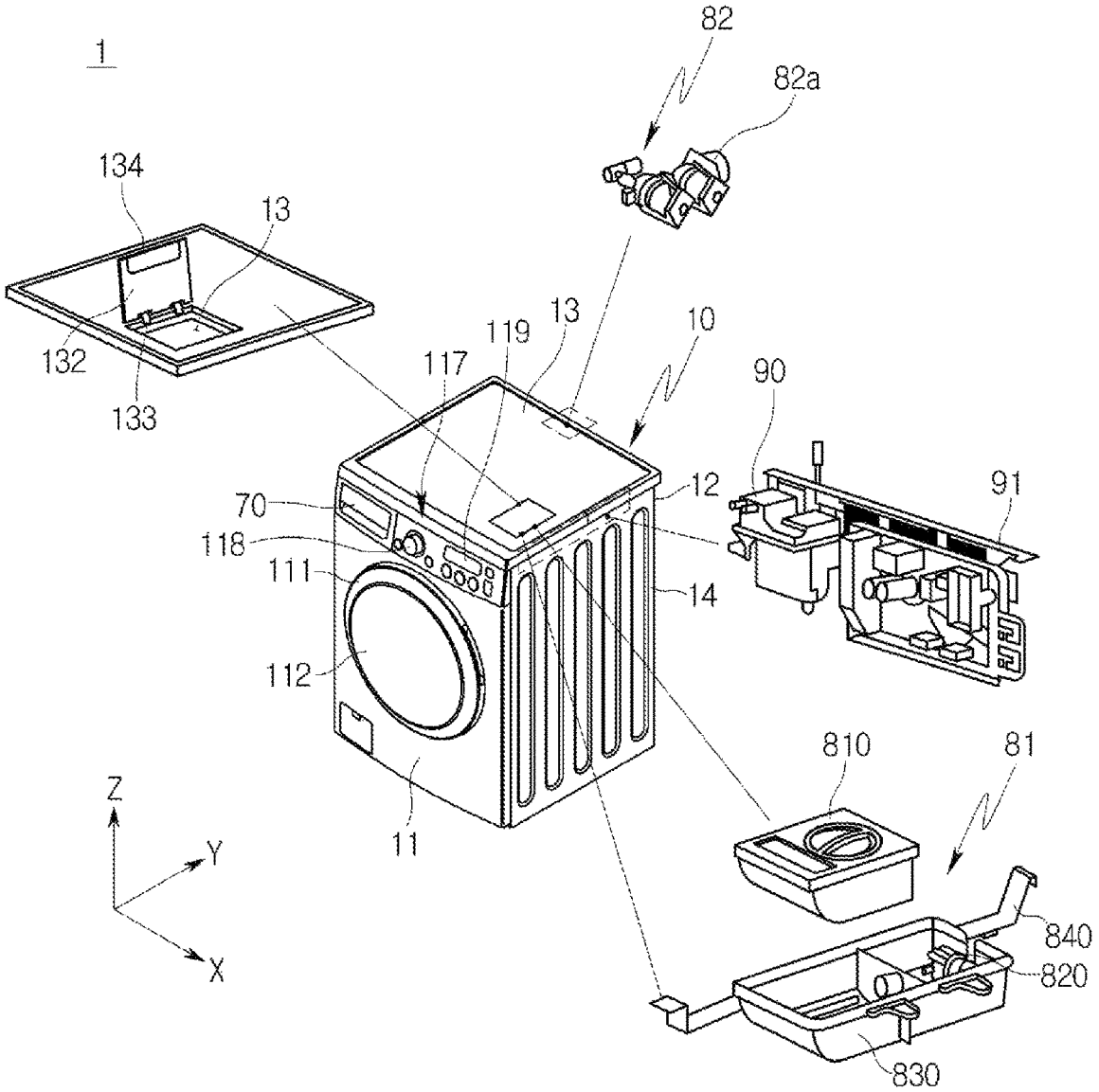
FIG. 1 is a schematic diagram showing a basic configuration of a laundry dryer according to the present invention.

Hereinafter, preferred embodiments of the present invention will be described in detail with reference to the accompanying drawings.

In the present invention, various modifications may be made and various embodiments may be provided, and specific embodiments will be illustrated in the drawings and described in detail in the detailed description. This is not intended to limit the present invention to a specific embodiment, and should be construed as including all changes, equivalents, and substitutes included in the spirit and scope of the present invention.

In describing the present invention, terms such as first and second may be used to describe various elements, but the elements may not be limited by terms. The terms are only for the purpose of distinguishing one component from another component. For example, without departing from the scope of the present invention, a first component may be referred to as a second component, and similarly, a second component may be referred to as a first component.

The term "and/or" includes a combination of a plurality of related described items or any of a plurality of related described items.

When a component is referred to as being "connected" or "contacted" to another component, it may be understood that it may be directly connected or contacted to the other component, but other components may exist in the middle. On the other hand, when a component is referred to as being "directly connected" or "directly contacted" to another component, it may be understood that there is no other component in the middle.

The terms used in the present application are only used to describe specific embodiments, and are not intended to limit the present invention. Singular expressions include plural expressions unless the context clearly indicates otherwise.

In the present application, terms such as "comprise" or "have" are intended to designate the existence of features, numbers, steps, actions, components, parts or a combination thereof described in the specification, and it may be understood that the possibility of the presence or addition of one or more other features or numbers, steps, actions, components, parts, or combinations thereof, is not preliminarily excluded.

Unless otherwise defined, all terms used herein including technical or scientific terms may have the same meaning as commonly understood by one of ordinary skill in the art to which the present invention belongs. Terms as defined in a commonly used dictionary may be interpreted as having a meaning consistent with the meaning in the context of the related technology, and unless explicitly defined in this application, it may not be interpreted as an ideal or excessively formal meaning.

In addition, the following embodiments are provided to more completely describe to those with average knowledge in the art, and the shapes and sizes of elements in the drawings may be exaggerated for clearer explanation.

Figure 2:
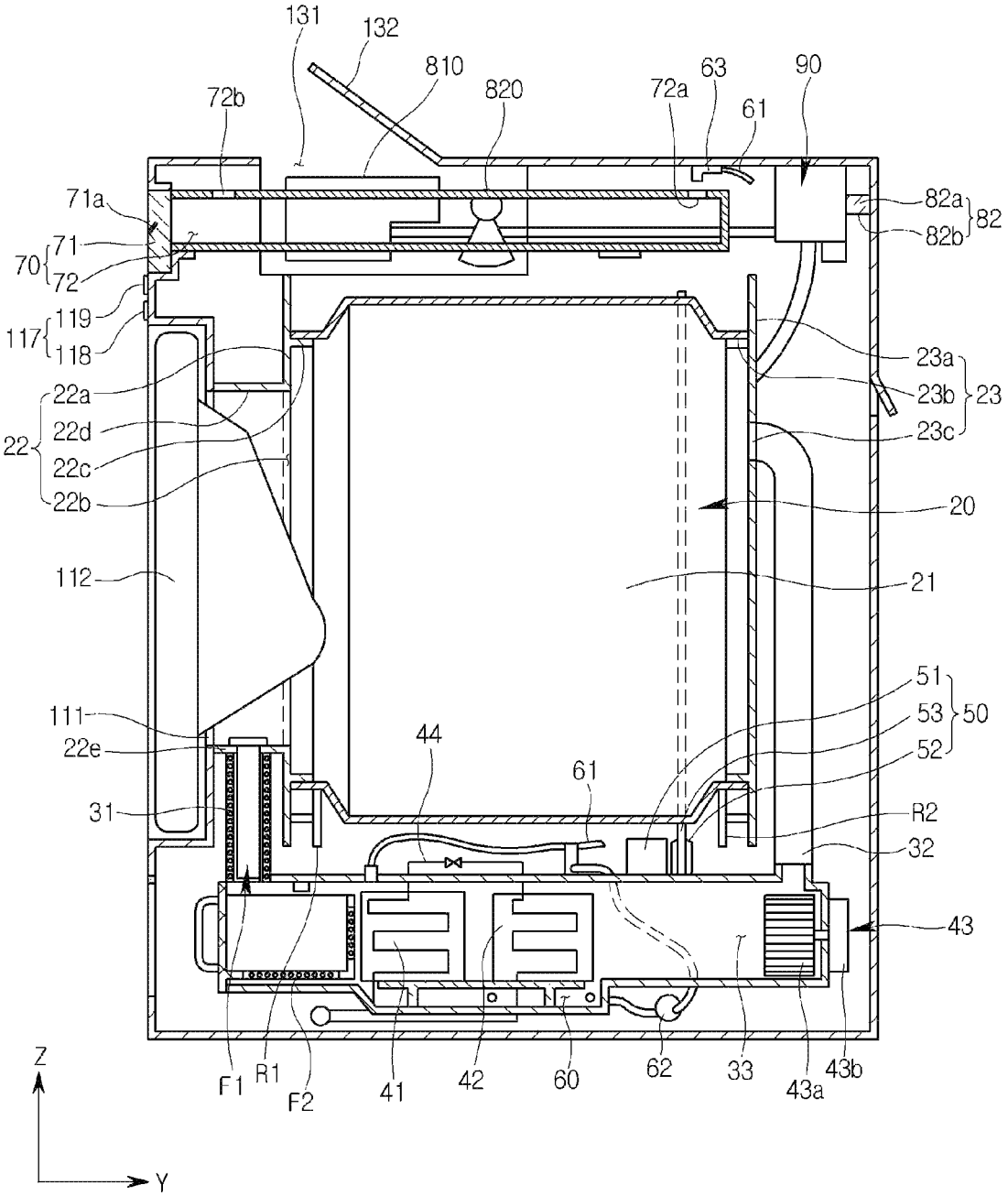
FIG. 2 is a cross-sectional view of FIG. 1.

FIG. 1 is a schematic diagram showing a basic configuration of a laundry dryer according to the present invention, and FIG. 2 is a cross-sectional view of FIG. 1.

As shown in FIGS. 1 and 2, a cabinet 10 forming an outer body of a laundry dryer 1 may include a front panel 11 constituting a front surface, a rear panel 12 constituting a rear surface, a pair of side panels 14 constituting side surfaces and an upper panel 13 constituting an upper surface of the laundry dryer 1.

The front panel 11 may be provided with an inlet 111 configured to communicate with a drum 20, which will be described later, and a door 112 rotatably coupled to the cabinet 10 to open and close the inlet 111.

A control panel 117 may be provided on the front panel 11.

The control panel 117 may be installed with an input unit 118 to receive a control command from a user, a display unit 119 to display information such as a control command selectable by a user and a main control unit (not shown) to control an operation command of the laundry dryer 1.

Meanwhile, the input unit 118 may be configured to include a power supply request unit to request power supply to the laundry dryer, a course input unit to allow a user to select a desired course among a plurality of courses and an execution request unit to request the start of the course selected by the user, and the like.

The display unit 119 may be configured to include at least one of a display panel to display characters and/or figures and a speaker to output an audio signal and a sound. A user can easily identify a current operation status and a remaining time by using the output information of the display unit 119.

The cabinet may include the drum 20 which is rotatably provided inside the cabinet 10 and provides a space for accommodating clothes, a duct unit 30 forming a flow path for resupplying the air discharged from the drum 20 to the drum 20 and a heat exchange unit 40 which dehumidifies and heats the air introduced into the duct unit 30 and then resupplies it to the drum 20.

The drum 20 may include a cylindrical drum body 21 with an open front surface. A first support unit 22 rotatably supporting the front surface of the drum body 21 and a second support unit 23 rotatably supporting the rear surface of the drum body 21 may be provided inside the cabinet 10.

The first support unit 22 may be configured to include a first fixing body **22*a* fixed to the inside of the cabinet 10, a drum inlet 22*b* passing through the first fixing body 22*a* and communicating the inlet 111 and the inside of the drum body 21 and a first support body 22*c* provided in the first fixing body 22*a* and inserted into the front surface of the drum body 21**.

The first support unit 22 may be configured to further include a connection body **22*d* connecting the inlet 111 and the drum inlet 22*b*. As shown, the connection body 22*d* may be provided in a pipe shape extending from the drum inlet 22*b* toward the inlet 111. In addition, the connection body 22*d* may be provided with an air outlet 22*e* communicating with the duct unit 30**.

As shown in FIG. 2, the air outlet 22*e* may be a passage that allows the internal air of the drum body 21 to move to the duct unit 30, and include a through hole penetrating the connection body 22*d*.

The second support unit 23 may be configured to include a second fixing body 23*a* fixed inside the cabinet 10 and a second support body 23*b* provided on the second fixing body 23*a* and inserted into the rear surface of the drum body 21.

The second support unit 23 may be provided with an air inlet 23*c* penetrating the second fixing body 23*a* and communicating the inside of the drum body 21 with the inside of the cabinet 10.

In this case, the duct unit 30 may be configured to connect the air outlet 22*e* and the air inlet 23*c*.

The drum body 21 in a cylindrical shape may rotate by various types of driving units 50.

For example, the driving unit 50 according to one embodiment, as shown in FIG. 2, may include a motor 51 fixed inside the cabinet 10, a pulley 52 rotated by the motor 51 and a belt 53 connecting the circumferential surface of the pulley 52 and the circumferential surface of the drum body 21.

In this case, the first support unit 22 may be provided with a first roller R1 rotatably supporting the circumferential surface of the drum body 21, and the second support unit 23 may be provided with a second roller R2 rotatably supporting the circumferential surface of the drum body 21.

However, the present invention is not limited thereto, and a direct driven driving unit in which the motor 51 is directly connected to the drum to rotate the drum without passing through a pulley and a belt may also be applicable, which naturally falls within the scope of the present invention. For convenience, the following description will be made based on the illustrated embodiment of the driving unit 50.

The duct unit 30 may include an exhaust duct 31 connected to the air outlet 22*e*, a supply duct 32 connected to the air inlet 23*c* and a connection duct 33 connecting the exhaust duct 31 and the supply duct 32 and having the heat exchange unit 40 installed inside therein.

The heat exchange unit 40 may be provided with various devices capable of sequentially performing dehumidification and heating of the air introduced into the duct unit 30. For example, the heat exchange unit 40 may be provided as a heat pump system.

As a heat pump system, the heat exchange unit 40 may include a circulation fan 43 to move air along the duct unit 30, a first heat exchanger (a heat absorbing unit) 41 to perform dehumidifying function by lowering the humidity of the air introduced into the duct unit 30 and a second heat exchanger (a heating unit) 42 provided inside the duct unit 30 to heat the air that has passed through the first heat exchanger 41.

The circulation fan 43 may be configured to include an impeller 43*a* provided in the duct unit 30 and an impeller motor 43*b* to rotate the impeller 43*a*.

The impeller 43*a* may be installed at any position among the exhaust duct 31, the connection duct 33 and the supply duct 32. In the embodiment shown in FIG. 2, the impeller 43*a* is provided on the connection duct 32, but the present invention is not limited thereto. For convenience hereinafter, it is described the embodiment in which the impeller 43*a* is provided in the connection duct 32.

The heat absorbing unit 41 and the heating unit 42 may be sequentially arranged along the direction from the exhaust duct 31 to the supply duct 32 in the connection duct 33, and connected to each other through a refrigerant pipe 44 forming a circulation flow path of the refrigerant.

The heat absorbing unit 41 may cool the air and evaporate the refrigerant by transferring the heat of the air introduced into the exhaust duct 31 to the refrigerant.

The heating unit 42 may heat the air and condense the refrigerant by transferring the heat of the refrigerant passing through a compressor 45 to the air.

In this case, when the moisture contained in the air passes through the heat absorbing unit 41, it moves along the surface of the heat absorbing unit 41 and collects on the bottom surface of the connection duct 33.

As described above, a configuration already known in the art may be adopted as the configuration of the heat exchange unit 40 of the heat pump system having the heat absorbing unit 41 and the heating unit 42, and detailed configurations related thereto will be omitted.

On the other hand, in order to collect the condensed water that is condensed from the air passing through the heat absorbing unit 41 and collected on the bottom surface of the connection duct 33, the laundry dryer 1 according to the present invention may be provided with a water collecting unit 60.

The condensed water condensed in the heat absorbing unit 41 may be first collected in the water collecting unit 60 and then secondly collected in the water storage unit 70. The water collecting unit 60 may be located inside the connection duct 33 as shown, or may be separately provided in a space spaced apart from the connection duct 33.

The condensed water first collected through the water collecting unit 60 may be supplied to the water storage unit 70 through the condensate water supply pipe 61. In this case, the condensate water supply pipe 61 may be provided with a condensate pump 62 to smoothly discharge the condensed water.

The water storage unit 70 may be configured to include a water storage tank 72 provided to be withdrawn from one side of the front panel 11 to an outside. The water storage tank 72 may be configured to collect the condensed water delivered from the water collecting unit 60, which will be described later.

A user can remove the condensed water by drawing out the water storage tank 72 from the cabinet 10 and then mount it in the cabinet 10 again. Accordingly, the laundry dryer according to the present invention may be disposed at any place where a sewer or the like is not installed.

In more detail, the water storage unit 70 may be configured to include the water storage tank 72 detachably provided in the cabinet 10 to provide a space for storing water and an inlet 72*a* provided to pass through the water storage tank 72 to introduce the water discharged from condensate water supply pipe 61 into the water storage tank 72.

The water storage tank 72 may be provided as a drawer-type tank drawn out from the cabinet 10. In this case, the front panel 11 of the cabinet may be provided with a reservoir mounting hole into which the water storage tank 72 is inserted.

A panel 71 may be fixed to the front surface of the water storage tank 72, and the panel 71 may be provided to form a part of the front panel 11 by detachably coupling it to the reservoir mounting hole.

The panel 71 may further include a groove portion 71*a* into which a user's hand is inserted and gripped. In this case, the panel 71 may also serve as a handle for drawing the water storage tank 72 out of the cabinet or inserting it into the cabinet.

The inlet 72*a* may be formed to receive condensed water discharged from a condensate nozzle 63 fixed to the cabinet 10. The condensate nozzle 63 may be fixed to the upper panel 13 of the cabinet 10 so that the water storage tank 72 is positioned above the inlet 72*a* when the water storage tank 72 is inserted into the cabinet 10.

A user can dispose of the water inside the water storage tank 72 by turning or tilting the water storage tank 72 toward the direction in which the inlet 72*a* is located after withdrawing the water storage tank 72 from the cabinet 10. A communication hole 72*b* may be further provided to penetrate the upper surface of the water storage tank 72 so that the water inside the water storage tank 72 can be easily discharged through the inlet 72*a*.

In addition, the laundry dryer 1 according to the present invention may include a first filter unit F1 and a second filter unit F2 as a means for removing foreign substances such as lint or dust generated during the drying process of laundry such as clothes.

The first filter unit F1 may be provided in the exhaust duct 31 to primarily filter foreign substances contained in the air discharged from the drum 20.

The second filter unit F2 may be placed downstream of the first filter unit F1 in the flow direction of the air so that the foreign substances contained in the air passing through the first filter unit F1 can be secondarily filtered. In more detail, as shown, the second filter unit F2 may be preferably placed on the upstream side of the first heat exchanger 41 in the connection duct 33. This can prevent the foreign substance contained in the air from accumulating in the first heat exchanger 41 acting as a heat absorbing unit and contaminating the first heat exchanger 41 or causing performance degradation.

As for the detailed configuration of the first filter unit F1 and the second filter unit F2, any means known in the art can be applied, so a description of the detailed configuration will be omitted.

Meanwhile, the laundry dryer 1 according to the present invention may further include a water supply unit 80 having an internal water supply unit 81 and an external water supply unit 82 and a steam unit 90 to generate steam by receiving water from the water supply unit 80.

The steam unit 90 may be provided to generate steam by receiving fresh water instead of condensed water. The steam unit 90 may be provided to generate steam by heating water, using ultrasonic waves, or vaporizing.

The steam unit 90 may be controlled to supply steam to the inside of the drum body 21 by receiving water from the internal water supply unit 81 as well as the external water supply unit 82 as needed.

The external water supply unit 82 may include a direct water valve 82*a* adjacent to the rear panel 13 or fixed to the rear panel 13, and a direct water pipe 82*b* to supply the water delivered from the direct water valve 82*a* to the steam unit 90.

The direct water valve 82*a* may be provided to be coupled to an external water supply source. For example, the direct water valve 82*a* may be coupled to a water supply pipe (not shown) extending to the rear surface of the cabinet. Accordingly, the steam unit 90 may be configured to receive water directly through the direct water valve 82*a*.

Therefore, even if the internal water supply unit 81 is omitted or water is not stored in the internal water supply unit 81, the steam unit 90 can receive water for steam generation through the direct water valve 82*a* when necessary.

The direct water valve 82*a* may be directly controlled by a steam control unit 100.

The steam control unit 100 may be installed on the control panel 117, but may be provided as a separate control panel to prevent overloading of the control panel 117 and not increase manufacturing cost, as shown in FIG. 1.

In this case, the steam control unit 100 may be provided adjacent to the steam unit 90. The steam control unit 100 may be provided on the side panel 14 on which the steam unit 90 is installed to reduce the length of a control line or the like connected to the steam unit 90.

On the other hand, the steam unit 90 may be preferably installed adjacent to the direct water valve 82*a*. Accordingly, it is possible to prevent unnecessary residual water from remaining in the direct water pipe 82*b*, and water can be immediately supplied when necessary.

Meanwhile, the internal water supply unit 81 may be configured to include a storage tank 810 to store water, a supply pump 820 to receive water from the storage tank 810 and to deliver water to the steam unit 90 and a tank housing 830 to provide spaces for accommodating the storage tank 810 and the supply pump 820.

A tank withdrawal hole 131 may be formed in an area of the upper panel 13 corresponding to the portion where the storage tank 810 is installed in the tank housing 830.

Since the storage tank 810 is smaller in volume than the water storage tank 72 of the water storage unit 70, it may be easily drawn out. Accordingly, the storage tank 810 may be provided to be withdrawn from the upper panel 13 upward. As a result, since the storage tank 810 and the water storage unit 70 are drawn in different directions from each other, a user can be less likely to get confused.

The upper panel 13 may be provided with a withdrawal cover 132 provided to shield the tank withdrawal hole 131 to prevent the storage tank 810 from being arbitrarily withdrawn.

The withdrawal cover 132 may include a panel coupling unit 133 provided to be coupled to the outer circumferential surface of the tank withdrawal hole 131. The panel coupling unit 133 may be provided extending from one side of the withdrawal cover 132 so as to rotatably couple the withdrawal cover 132 to the upper panel 13. The panel coupling unit 133 and the upper panel 13 may be coupled and provided in a hinge coupling manner.

On the other hand, the withdrawal cover 132 may be provided with a panel handle 134 on the surface that can be gripped by a user, and the panel handle 134 may be composed of a groove formed concave toward the lower portion of the withdrawal cover 132.

Figure 3:
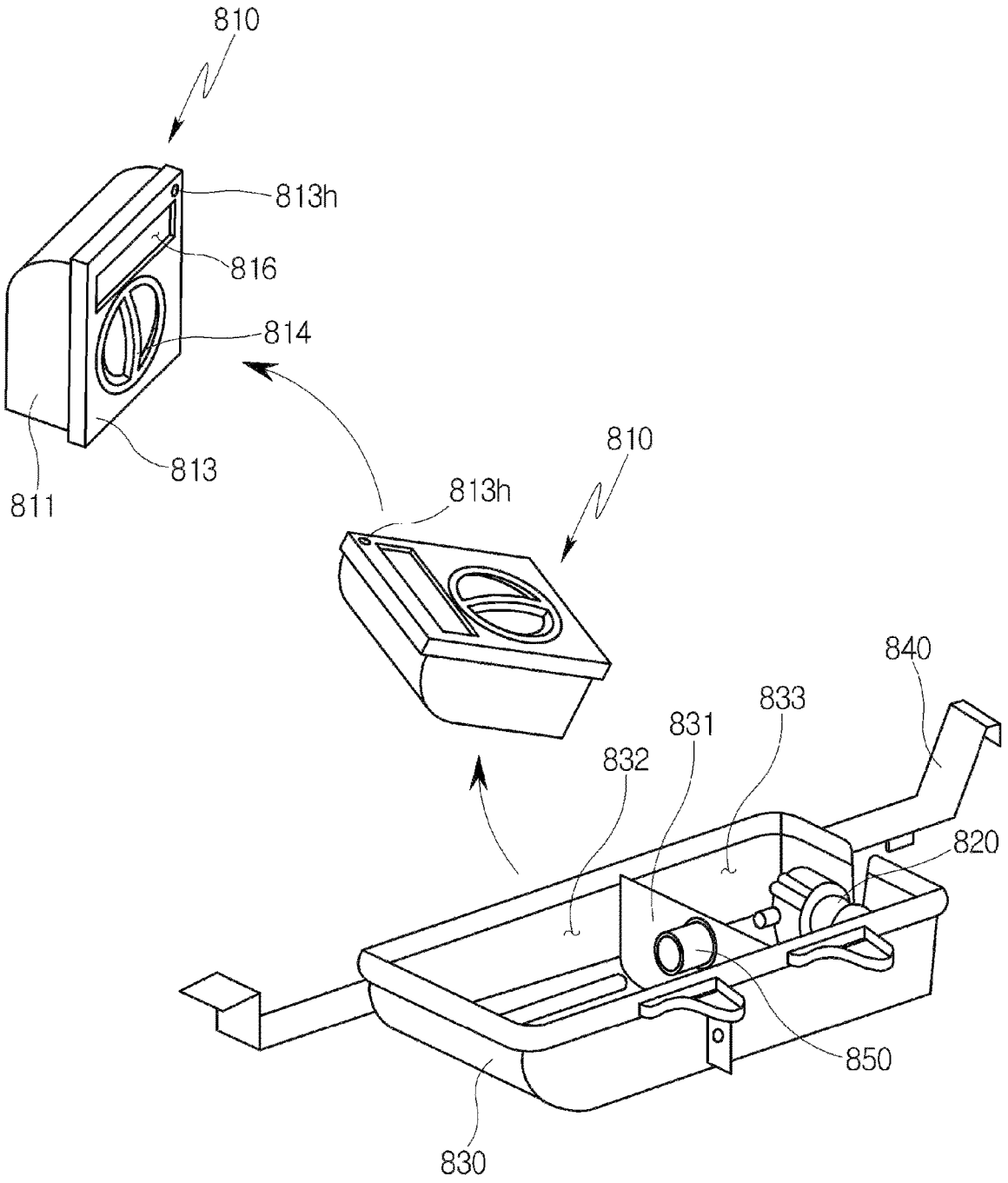
FIG. 3 is a schematic perspective view showing a state in which a storage tank is separated from a tank housing in a laundry dryer according to the present invention

As shown in FIG. 3, the tank housing 830 may accommodate both a storage tank 810 and a supply pump 820 supplying the water stored in the storage tank 810.

Thus, the tank housing 830 may be divided into a tank receiving unit 832 accommodating the storage tank 810 and a pump receiving unit 833 accommodating the supply pump 820, and the tank receiving unit 832 and the pump receiving unit 833 may be divided using a partition wall 831.

Even if water leaks from the storage tank 810 through the partition wall 831, the leaked water can be blocked from moving to the pump receiving unit 833 in which the supply pump 820 driven by electricity is accommodated, and an accident due to a short circuit and the failure of the supply pump 820 can be prevented.

The partition wall 831 may be configured to extend through the connection pipe 850 connecting the supply unit 817 of the storage tank 810 and the supply pump 820.

The tank housing 830 may be fixed and supported inside the laundry dryer through a support bar 840. One end and the other end of the support bar 840 have a structure that can be fixed to a frame and the internal structure of the laundry dryer or to the cabinet 10.

In addition, one side of the tank housing 830 may be coupled between the one end and the other end of the support bar 840.

Meanwhile, a floater sensor SF, which will be described later, may be fixed to the other side of the tank housing 830. The floater sensor SF may measure the water level inside the storage tank 810 and transmit the sensed water level to the above-described main control unit, and the main control unit may notify a user of a water replenishment alarm through a display unit 119. The configuration of the floater sensor SF and the fixing structure to the floater sensor SF will be described later with reference to FIG. 5.

When a user opens the withdrawal cover 132 described above in order to replenish water, the storage tank 810 may be exposed to an outside.

In this case, a user can separate the storage tank 810 from the tank housing 830 by simply griping and pulling a handle unit 816 formed on the front upper side surface of the storage tank 810 (in a direction toward the front panel of the cabinet) based on the state in which the storage tank 810 is accommodated in the tank housing 830 (in a flat state).

For easy separation of the storage tank 810, as shown in FIG. 3, the front lower portion of the storage tank 810 may be formed as a convex downward curved surface having a predetermined curvature, and the curved surface corresponding to the curved surface of the storage tank 810 may be formed on the tank housing 830.

After the storage tank 810 is detached, when a user grips the handle unit 816 and moves to a position for replenishing water, the handle unit 816 of the storage tank 810, as shown at the top of FIG. 3, may be in the upward direction. That is, it becomes a standing state by rotating 90 degrees based on the state in which the storage tank 810 is accommodated in the tank housing 830.

On the other hand, a user can open a water supply cap 814 in a state in which the storage tank 810 is laid down in the same manner as the state accommodated in the tank housing 830 and supply water to the internal storage space S of the storage tank 810, and then, close the water supply cap 814 again and complete water replenishment.

The coupling of the storage tank 810 may be performed in the reverse order of the separation process described above.

Figure 4:
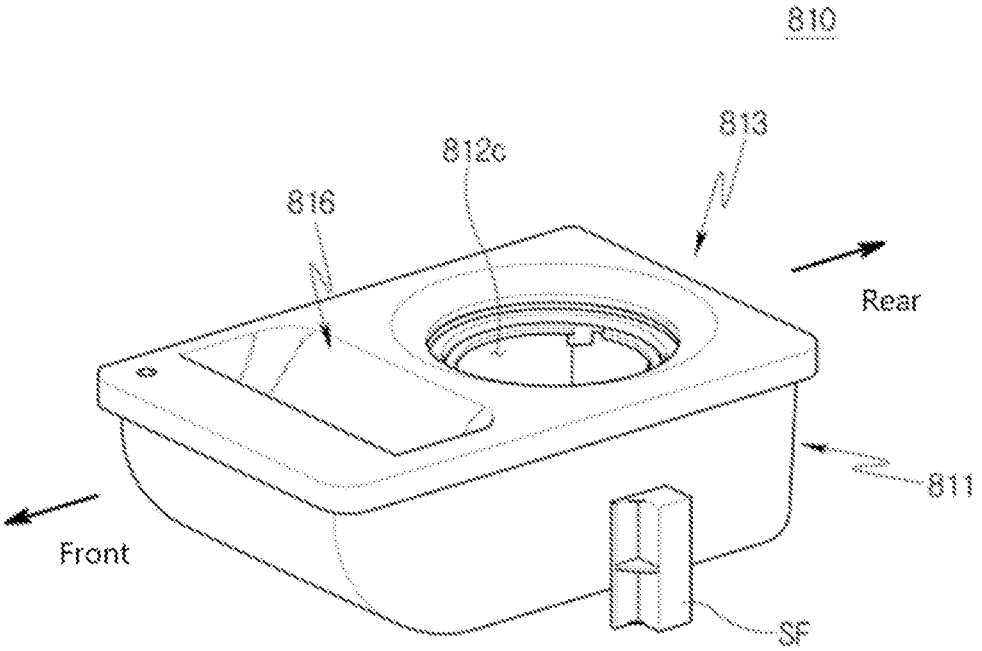
FIG. 4 is a perspective view of a storage tank of a laundry dryer according to the present invention.
Figure 5:
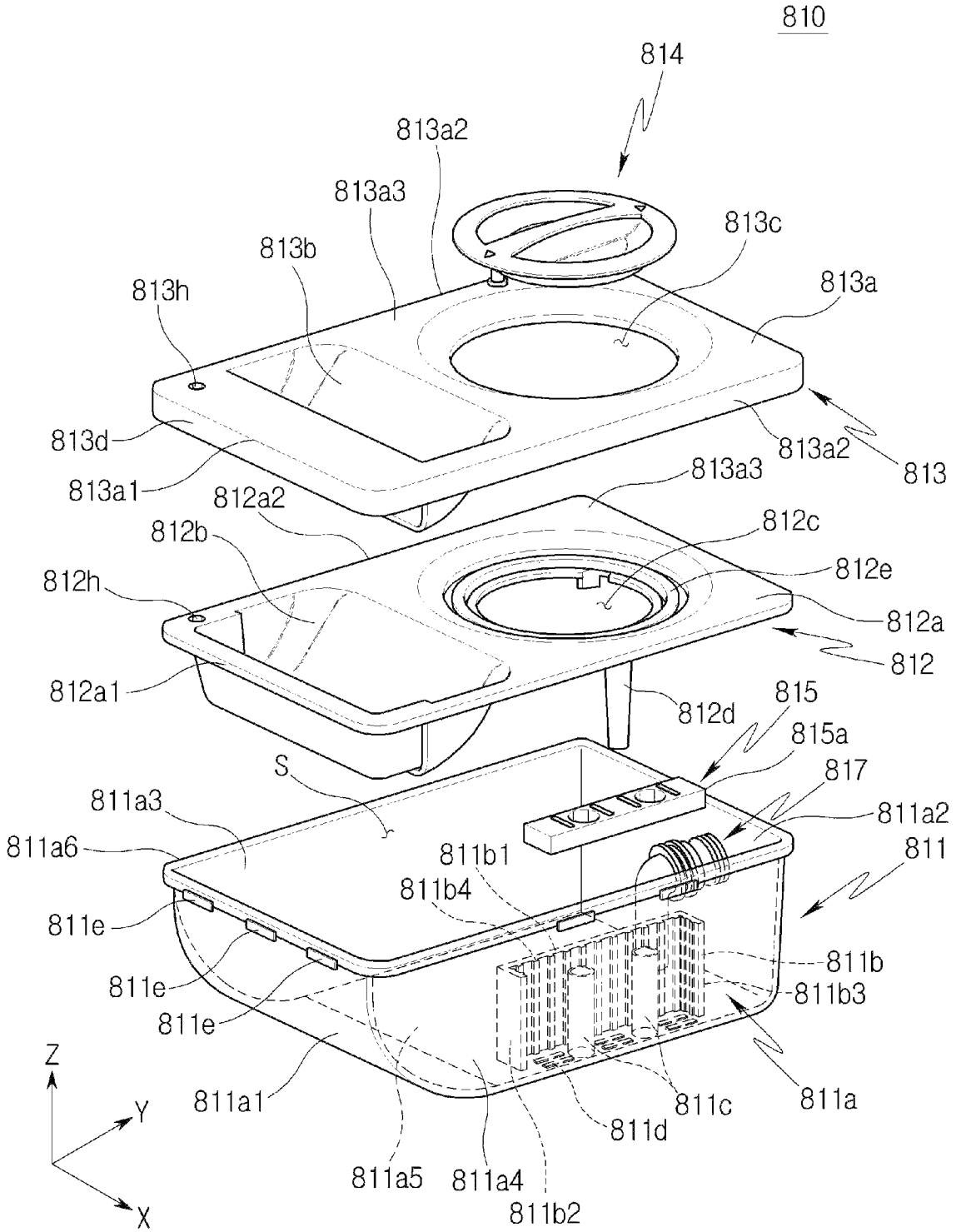
FIG. 5 is an exploded perspective view of FIG. 4.

FIG. 4 is a perspective view of a storage tank 810 of the laundry dryer according to the present invention and FIG. 5 is an exploded perspective view of FIG. 4.

Hereinafter, a detailed configuration of the storage tank 810 will be described with reference to FIGS. 4 and 5.

As described above, the storage tank 810 may store water to be supplied to the steam unit 90 in an airtight manner.

The storage tank 810 may include a tank body 811 having a storage space S formed therein and a tank cover 812 coupled to the open upper side surface of the tank body 811.

The tank body 811 may be configured to include a main body portion 811*a* in a box shape having an open upper side surface to store water therein, and a closed front surface 811*a*1, rear surface 811*a*2, first side surface 811*a*3, second side surface 811*a*4 and lower side surface 811*a*5. The tank body 811 may be manufactured by a plastic injection method in consideration of sealing properties, processability and light weight of the storage space S.

As described above, the front surface 811*a*1 of the main body portion 811*a* may be formed to have a convex downward curved surface with a predetermined curvature in order to easily separate the storage tank 810 from the tank housing 830. The first side surface 811*a*3, the second side surface 811*a*4, and the rear surface 811*a*2 may be formed in a simple planar structure.

The supply unit 817 may be installed on the rear surface 811*a*2 of the main body portion 811*a* of the tank body 811.

The supply unit 817 may deliver the water stored in the storage space S of the tank body 811 to the outside of the tank body 811, and include a check valve penetrating the rear surface 811*a*2 of the tank body 811 and a water supply pipe having a shape that is bent in an L-shape toward the lower side surface 811*a*5 of the main body portion 811*a* of the tank body 811 from the check valve.

The check valve may be connected in a fitting manner with the connection pipe 850 of the tank housing 830 described above, and regulate the internal flow path so that water is supplied from the water supply pipe to the connection pipe 850 only when connected to the connection pipe 850.

As for the configuration of the check valve and the water supply pipe, a means already known in the art can be applied, and a detailed description of the configuration will be omitted.

A floater 815 may be placed at a position adjacent to either the first side surface 811*a*3 or the second side surface 811*a*4 in the storage tank 810 to measure the level of stored water.

FIG. 5 illustrates an embodiment in which the floater 815 is placed in a position adjacent to the second side surface 811*a*4, but the present invention is not limited thereto. However, for the purpose of convenience, the following description will be made based on an embodiment in which the floater 815 is placed at a position adjacent to the second side surface 811*a*4, and a detailed configuration will be described later with reference to FIG. 6.

The tank cover 812 may be coupled to the open upper side surface of the tank body 811 and cover the upper side surface of the tank body 811 to form a storage space S therein together with the tank body 811.

As shown in FIG. 5, the tank cover 812 may have a rectangular flat plate 812*a* having an approximately uniform thickness, and a first concave surface 812*b* formed close to the front edge 812*a*1 of the flat plate 812*a*.

In order to prevent leakage, the circumferential surface including the front edge 812*a*1, side edge 812*a*2 and rear edge of the tank cover 812 and the upper end portion 811*a*6 of the tank body 811 may be coupled to each other in a fusion bonding to form a fusion portion.

In order to increase the fusion strength and reduce the possibility of leakage, the upper end portion 811*a*6 of the tank body 811 and the circumferential surface of the tank cover 812 forming the fusion surface may be formed as a stepped surface.

The tank cover 812 can be manufactured by a plastic injection method like the tank body 811 in order to be easily fused with the tank body 811, and the fusion can be made by using any method already known in the art such as thermal fusion, ultrasonic fusion, etc.

The first concave surface 812*b* may be a configuration for forming the handle unit 816 together with a second concave surface 813*b* of a decorative cover 813 to be described later.

The first concave surface 812*b* may be configured as an inclined curved surface that is convex downward so as to have a depth enough to be easily gripped by a user, and has the shape of a curved surface that is entirely blocked.

Meanwhile, a water supply hole 812*c* may be formed between the first concave surface 812*b* and the rear edge.

A water supply cap 814 may be detachably fastened to the water supply hole 812*c*. A user can separate the water supply cap 814 from the water supply hole 812*c* by rotating the water supply cap 814 in the locked state in the release direction. In the state where the water supply cap 814 is separated, water can be replenished.

In the water supply hole 812*c*, a step portion 812*e* extending toward the inside of the tank body 811 may be installed as a structure for fastening the water supply cap 814 to be detachable and improving the sealing performance of the water supply cap 814.

As for the configuration of the detachable structure between the water supply hole 812*c* and the water supply cap 814, a means already known in the art can be applied, and a detailed description of the configuration will be omitted.

Meanwhile, the step portion 812*e* extending toward the inside of the tank body 811 may also act as a means for visually recognizing the maximum storage capacity of the storage tank 810 to a user.

Thus, while a user separates the water supply cap 814 to replenish water, it acts as a means to visually inform the user that water cannot be added any more when the water level reaches the bottom of the step portion 812*e*. A visual means such as a character or a leader line may be further added to the step portion 812*e* as a means for informing the maximum water level and maximum capacity limitation.

Meanwhile, a second intake hole 812*h* extending through the flat plate 812*a* between the first concave surface 812*b* and the side edge 812*a*2 may be formed at a position close to the front edge 812*a*1 of the tank cover 812.

The second intake hole 812*h* may act as an intake hole for forming an air flow path by communicating the storage space S of the storage tank 810 and an external space together with a first intake hole 813*h* to be described later.

The second intake hole 812*h* may be formed at a position avoiding the above-described fusion portion so as to form an unblocked air flow path.

On the other hand, the storage tank 810 of the laundry dryer according to the present invention may further include a decorative cover 813 attached to the upper side surface 812*a*3 of the tank cover 812 and to at least partially cover the upper side surface 812*a*3 of the tank cover 812.

As an example, FIGS. 4 and 5 illustrate a decorative cover 813 covering all of the upper side surface 812*a*3 of the tank cover 812, but the present invention is not limited thereto, and the configuration of the decorative cover 813 covering a part of the upper side surface 812*a*3 belongs to the scope of the present invention. For convenience, the following description will be made with respect to the configuration of the decorative cover 813 covering the entire upper side surface 812*a*3 of the tank cover 812.

The decorative cover 813 may be manufactured by injection molding in the same manner as the tank body 811 and the tank cover 812. It may be attached to the upper side surface 812*a*3 of the tank cover 812 to protect the upper side surface 812*a*3 of the tank cover 812 and to improve user convenience by forming the handle unit 816 together with the first concave surface 812*b* of the tank cover 812 described above.

For enhancing such convenience function, a second concave surface 813*b* in the form of a convex downward curved surface at a position corresponding to the above described first concave surface 812*b* may be provided on a flat plate 813*a* of the decorative cover 813.

The second concave surface 813*b* may be formed to have a shape corresponding to the first concave surface 812*b* only partially. Therefore, the second concave surface 813*b* may function as a space in which a finger can enter when a user is gripping it, and the portion between a front edge 813*a*1 of the flat plate 813*a* and the second concave surface 813*b*, as a portion where the concave surface is not formed, may function as a grip unit through which the user's finger can be caught.

The decorative cover 813 may be configured to be detachably fastened to the tank body 811. To this end, the decorative cover 813 may include an edge portion 813*d* extending from the front edge 813*a*1, a side edge 813*a*2 and rear edge of the flat plate 813*a* toward the tank body 811.

In addition, a plurality of locking protrusions 811*e* that fits to the edge portion 813*d* of the decorative cover 813 may be formed on the upper end portion 811*a*6 of the tank body 811 that is a position corresponding to the edge portion 813*d* during fastening.

On the other hand, a through hole 813*c* having a shape corresponding to the water supply hole 812*c* of the tank cover 812 may be formed between the second concave surface 813*b* and the rear edge of the flat plate 813*a* and at a position corresponding to the water supply hole 812*c* of the tank cover 812.

In addition, a first intake hole 813*h* extending through the upper side surface 813*a*3 and the lower side surface 813*a*4 of the flat plate 813*a* may be formed at a position close to the front edge 813*a*1 of the decorative cover 813 and between the second concave surface 813*b* and the front edge 813*a*1.

The first intake hole 813*h* may act as an intake hole for forming an air flow path by communicating the storage space S of the storage tank 810 with an external space, together with the second intake hole 812*h* as described above.

FIGS. 6 to 9 show a detailed configuration of the floater 815.

Referring to FIGS. 6 to 9, the floater 815 may include a body portion 815*a* made of a plastic material having a predetermined rigidity but having a lower density than water so that the position in the vertical direction can be moved according to the water level.

In more detail, as shown, the body portion 815*a* may be configured to have a hexahedral shape having a first outer surface 815*a*1 and a second outer surface 815*a*2 formed parallel to each other and spaced apart by a first interval Hf, a third outer surface 815*a*3 and a fourth outer surface 815*a*4 formed parallel to each other and spaced apart by a second interval Wf, and a fifth outer surface 815*a*5 and a sixth outer surface 815*a*6 formed parallel to each other and spaced apart by a third interval Lf.

In this case, the first outer surface 815*a*1 to the sixth outer surface 815*a*6 may all be formed as flat surfaces, and the first interval Hf, the second interval Wf and the third interval Lf may be respectively different from each other. Preferably, the first interval Hf may be the shortest and the third interval Lf may be the longest, and it may be a bar-shaped rectangular prism.

However, as described above, the present invention may firstly provide a more reliable detection performance for the water level while maintaining a floating state of the floater 815 even with an amount less than the amount required for performing the steam process.

In order to minimize the height of the floater 815 based on the state in which the storage tank is accommodated in the tank housing, the floater 815 may be installed in the storage tank so that the first interval Hf among the first interval Hf, the second interval Wf and the third interval Lf acts as the height of the floater 815.

That is, the floater 815 may be installed in the storage tank such that the first outer surface 815*a*1 becomes the upper side surface, and the second outer surface 815*a*2 becomes the lower side surface.

In this case, the third outer surface 815*a*3 and the fourth outer surface 815*a*4 may become a first side surface and a second side surface, respectively, and the fifth outer surface 815*a*5 and the sixth outer surface 815*a*6 may be defined as a front surface and a rear surface, respectively.

On the other hand, if the first interval Hf corresponding to the smallest interval is selected as the height in the vertical direction, that is, in a gravitational direction, it may be difficult to generate sufficient buoyancy while submerged in water. In particular, since a magnet M having a density much higher than that of water is embedded inside the floater 815 as described later, it is necessary to increase the buoyancy of the floater 815 in order to measure the water level more accurately.

Thus, the floater 815 according to one embodiment of the present invention may be formed such that the third interval Lf that is the total length of the floater 815 and the second interval Wf that is the total width of the floater 815 have a fairly large ratio compared to the first interval Hf, thereby increasing the buoyancy of the entire floater 815.

Preferably, the third interval Lf acting as the total length may be formed to be 8 to 10 times larger than the first interval Hf, and the second interval Wf acting as the entire width may be formed to be 1.5 to 2.5 times larger than the first interval Hf.

As described above, by limiting the ratio of the second interval Wf and the third interval Lf to the first interval Hf, the floating state in which the body portion 815*a* of the floater 815 is at least partially exposed above the water surface can be maintained.

In addition, the first interval Hf may be limited compared to the movable section Hs of the floater 815 defined as the height from the lower side surface 811*a*5 of the tank body 811 to the other end of a stopper 812*d*, as described later.

That is, by setting the movable section Hs of the floater 815 to be 2.5 to 3.5 times larger than the first interval Hf, a margin for the movement of the floater 815 and the magnet M can be secured, and it is possible to accurately specify the water level at which water shortage occurs.

Meanwhile, a magnet M may be embedded in the body portion 815*a* of the floater 815 so that the water level can be measured in a manner that detects changes in magnetic force or magnetism.

In this case, as described above, the vertical height among the sizes of the embedded magnet M may be configured to be maintained at a predetermined ratio compared to the first interval Hf of the floater 815 so as to provide a reliable detection performance. Preferably, the vertical height of the magnet M may be limited to 0.5 to 0.8 times the first interval Hf.

Figure 8:
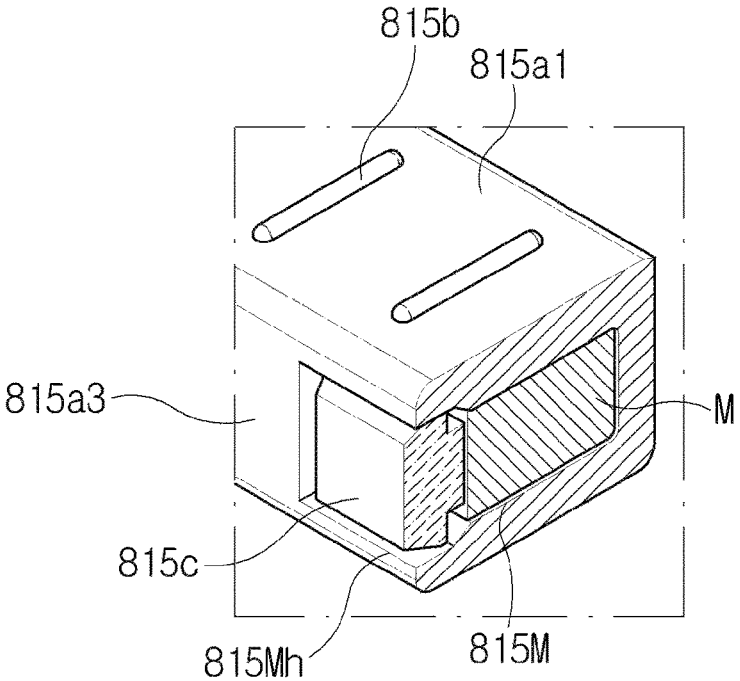
FIG. 8 is a cross-sectional view in the direction A-A' of FIG. 6.
Figure 9:
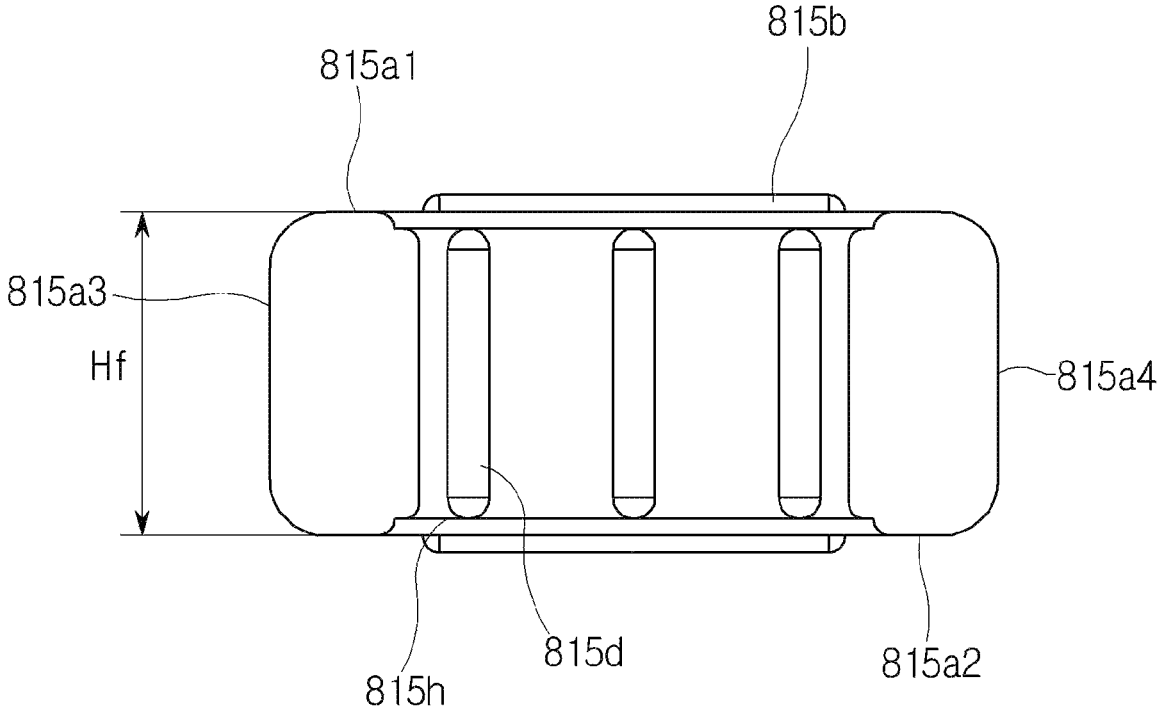
FIG. 9 is a cross-sectional view in the direction B-B' of FIG. 6.

As shown in FIG. 8, a magnet receiving unit 815M, in which a magnet M is inserted and embedded, may be formed in a groove shape in the body portion 815*a*.

In this case, in order to form a symmetrical structure of the floater 815 and the magnet M, as described later, the distance from the magnet M to the third outer surface 815*a*3 and the distance from the magnet M to the fourth outer surface 815*a*4 can be set equally in the state where the insertion into the magnet receiving unit 815M is completed.

For the same reason, the distance from the magnet M to the first outer surface 815*a*1 and the distance from the magnet M to the second outer surface 815*a*2 can be set equally.

In the illustrated embodiment, a magnet M having a hexahedral shape and a magnet receiving unit 815M having a shape corresponding to the outer shape of the magnet M are formed, but the present invention is not limited thereto, and the magnet M of various shape may be applicable, and the shape of the magnet receiving unit 815M may be changed correspondingly. Hereinafter, a description will be made based on a magnet M having a hexahedral shape as an example.

After the magnet M is inserted into the open insertion hole 815Mh of the magnet receiving unit 815M, the insertion hole 815Mh may be closed through a magnet cover 815*c*.

The magnet cover 815*c* may be configured to have a shape corresponding to the shape of the insertion hole 815Mh, and the magnet cover 815*c* may be coupled to the insertion hole 815Mh by a method such as forced press-fitting.

On the other hand, a first through hole 815*h*1 and a second through hole 815*h*2 each having the same cylindrical shape may be formed in the body portion 815*a* with the magnet M interposed therebetween by extending through the first outer surface 815*a*1 and the second outer surface 815*a*2.

When the floater 815 is installed in the storage tank, a guide bar 811*c* may extend through the first through hole 815*h*1 and the second through hole 815*h*2, and the floater 815 may be guided to move only in the vertical direction along the water surface through the first through hole 815*h*1 and the second through hole 815*h*2. Thus, the floater 815 can be prevented from being separated from a predetermined position.

Meanwhile, the distance between the magnet M and the center of the first through hole 815*h*1 and the distance between the magnet M and the center of the second through hole 815*h*2 may be set equal to each other.

In addition, the distance from the fifth outer surface 815*a*5 of the body portion 815*a* to the center of the first through hole 815*h*1 and the distance from the sixth outer surface 815*a*6 to the center of the second through hole 815*h*2 may be set equal to each other.

In this way, when the position of the first through hole 815*h*1, the position of the second through hole 815*h*2 and the position of the magnet M are set, it can maintain the first through hole 815*h*1, the second through hole 815*h*2 and the magnet M in a left-right symmetrical shape and a vertically symmetrical shape based on the center of the magnet M. When the floater 815 is installed, an assembly is possible even in a reversed state in which the first outer surface 815*a*1 and the second outer surface 815*a*2 are inverted and the fifth outer surface 815*a*5 and the sixth outer surface 815*a*6 are inverted. Thus, it is possible to prevent defects due to misassemblies.

Meanwhile, inside the first through hole 815*h*1 and the second through hole 815*h*2, a plurality of internal ribs 815*d* protruding from respective inner circumferential surfaces may be provided.

Figure 7:
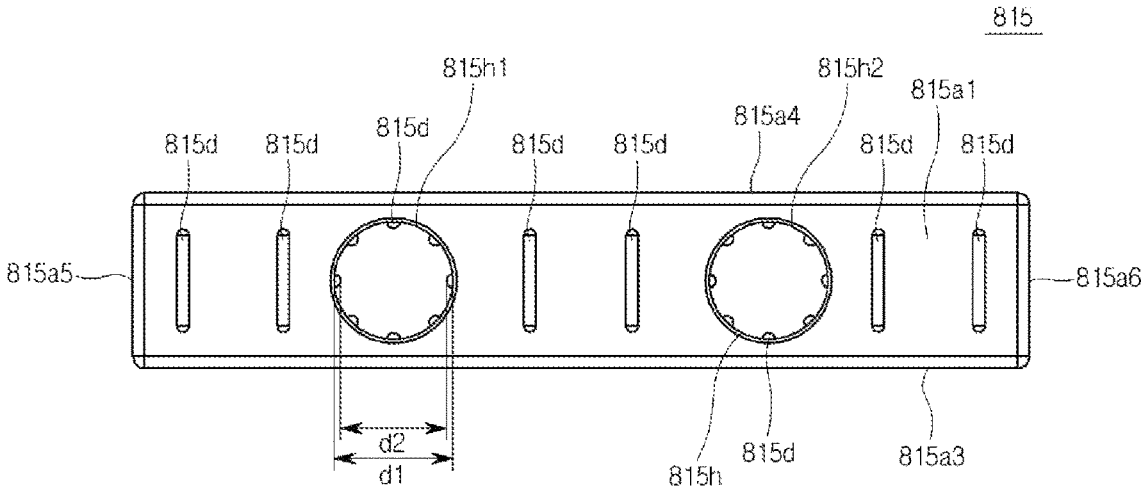
FIG. 7 is a plan view of FIG. 6.

Each of the plurality of inner ribs 815*d* may be configured to have a linear shape extending in a direction from the first outer surface 815*a*1 toward the second outer surface 815*a*2 of the body portion 815*a*, as shown in FIG. 7, each may have the same shape and be spaced equally apart from each other.

FIG. 7 shows an embodiment in which a total of eight internal ribs 815*d* are provided in the first through hole 815*h*1 and the second through hole 815*h*2, respectively, but this is only an example and its number and size can be adjusted according to the overall size of the floater 815 and the inner diameter d1 of the first through hole 815*h*1 and the second through hole 815*h*2. Hereinafter, it is described based on the illustrated embodiment.

As described above, the guide bar 811*c* may be inserted and passed through the first through hole 815*h*1 and the second through hole 815*h*2, respectively.

Since the floater 815 moves vertically along the outer surface of the guide bar 811*c* in a stationary state, a frictional force may be generated between the outer surface of the guide bar 811*c* and the inner surface of the first through hole 815*h*1, and the outer surface of the guide bar 811*c* and the inner surface of the second through hole 815*h*2, so that smooth movement of the floater 815 may be hindered.

Therefore, the effective inner diameter d2 of the first through hole 815*h*1 and the second through hole 815*h*2 can be limited to the diameter of virtual circle connecting the upper ends of the individual inner ribs 815*d* of the plurality of inner ribs 815*d*. Thus, the direct contact of the inner circumferential surface of the first through hole 815*h*1 and the inner circumferential surface of the second through hole 815*h*2 can be prevented, and a contact area with respect to the guide bar 811*c* can be minimized. Accordingly the frictional force that hinders the movement of the floater 815 can be minimized and smooth vertical movement of the floater 815 can be ensured.

In addition, a plurality of outer ribs 815*b* protruding and extending in a straight line may be provided on the first outer surface 815*a*1 and the second outer surface 815*a*2 of the body portion 815*a*.

In this case, each of the plurality of outer ribs 815*b* may be configured to have the same shape.

The plurality of outer ribs 815*b* can minimize the contact area between the lower side surface 811*a*5 of the tank body 811 and the second outer surface 815*a*2 of the body portion 815*a*. This can prevent a phenomenon in which the floater 815 is fixed to the lower side surface 811*a*5 of the tank body 811 and the floater 815 does not float along the water surface.

Figure 6:
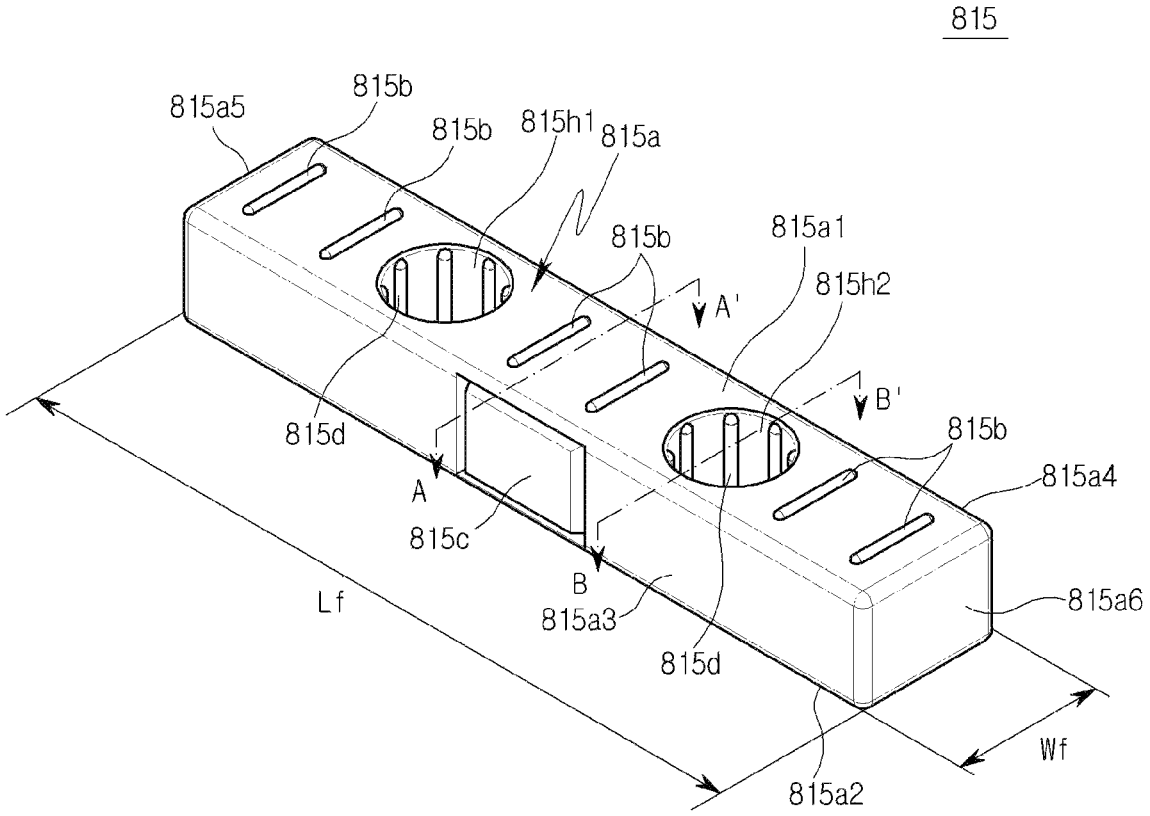
FIG. 6 is a perspective view of the floater shown in FIG. 5.

FIGS. 6 to 8 show an embodiment in which a total of six outer ribs 815*b* are formed only on the first outer surface 815*a*1 corresponding to an upper side surface, but it is configured to form the outer rib 815*d* of the same shape in a symmetrical position on the second outer surface 815*a*2 corresponding to a lower side surface In the other hand, as described later, a plurality of bottom ribs 811*d* may be formed on the position of the lower side surface 811*a*5 of the tank body 811 corresponding to the second outer surface 815*a*2 of the floater 815, so that the bottom ribs 811*d* may be in contact with the external ribs 815*b* in a state in which the floater 815 is moved to the lowest position P1.

In this case, the plurality of bottom ribs 811*d* may be each configured to have a linear shape, but extend in a direction intersecting with the outer ribs 815*b* so that the contact area with the outer ribs 815*b* can be minimized. The detailed configuration of the bottom rib 811*d* is described later.

Meanwhile, the floater sensor SF for detecting the position of the magnet M provided in the floater 815 may be attached on the other side of the tank housing 830.

Figure 10:
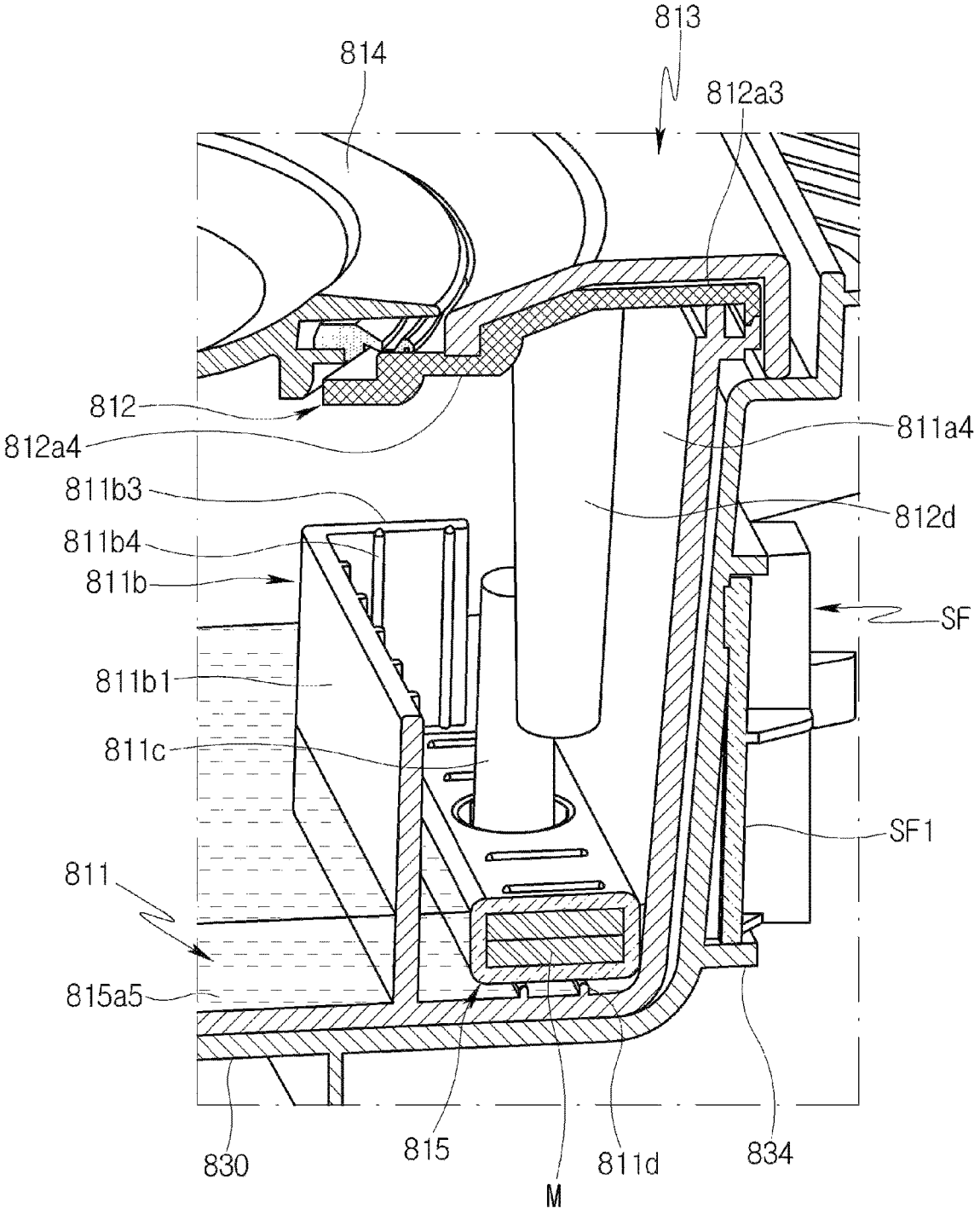
FIGS. 10 and 11 are cross-sectional views of FIG. 4.

The floater sensor SF may be fixed to a sensor installation unit 834 integrally formed the outside of the tank housing 830 as shown in FIG. 10.

The floater sensor SF may include a sensing unit SF1 extending in a vertical direction between the lowest position P1 and the highest position P2 of the magnet M and identifying the center position Cf of the magnet M moving vertically according to the water level. The effective sensing surface of the sensing unit SF1 may be configured to extend in a direction parallel to the moving direction of the magnet M in order to measure the change of magnetic force or change of magnetism to be changed according to the moving direction of the magnet M.

Since any means capable of detecting a change in magnetic force or magnetism is applicable as the sensing unit SF1 of the floater sensor SF, a detailed description of the configuration will be omitted.

On the other hand, as described above, the present invention can simplify the manufacturing process of the storage tank and significantly reduce the manufacturing cost by integrally forming a floater case 811*b* that guides the vertical movement of the floater 815 in the storage tank.

To this end, at a position adjacent to the second side surface 811*a*4 of the tank body 811 in which the floater 815 is disposed, the floater case 811*b* and the guide bar 811*c* may be formed as a means for preventing separation of the floater 815 and guiding the movement in the vertical direction (Z direction).

First, as shown, the floater case 811*b* may have a U-shape, be configured to have a shape protruding upward from the lower side surface 811*a*5 of the main body portion 811*a* of the tank body 811 and be injection molded integrally with the main body portion 811*a*.

Therefore, by integrally forming the floater case 811*b* with the tank body 811, the manufacturing cost can be reduced and the manufacturing process can be simplified compared to the conventional manufacturing process of separately forming and assembling.

Figure 11:
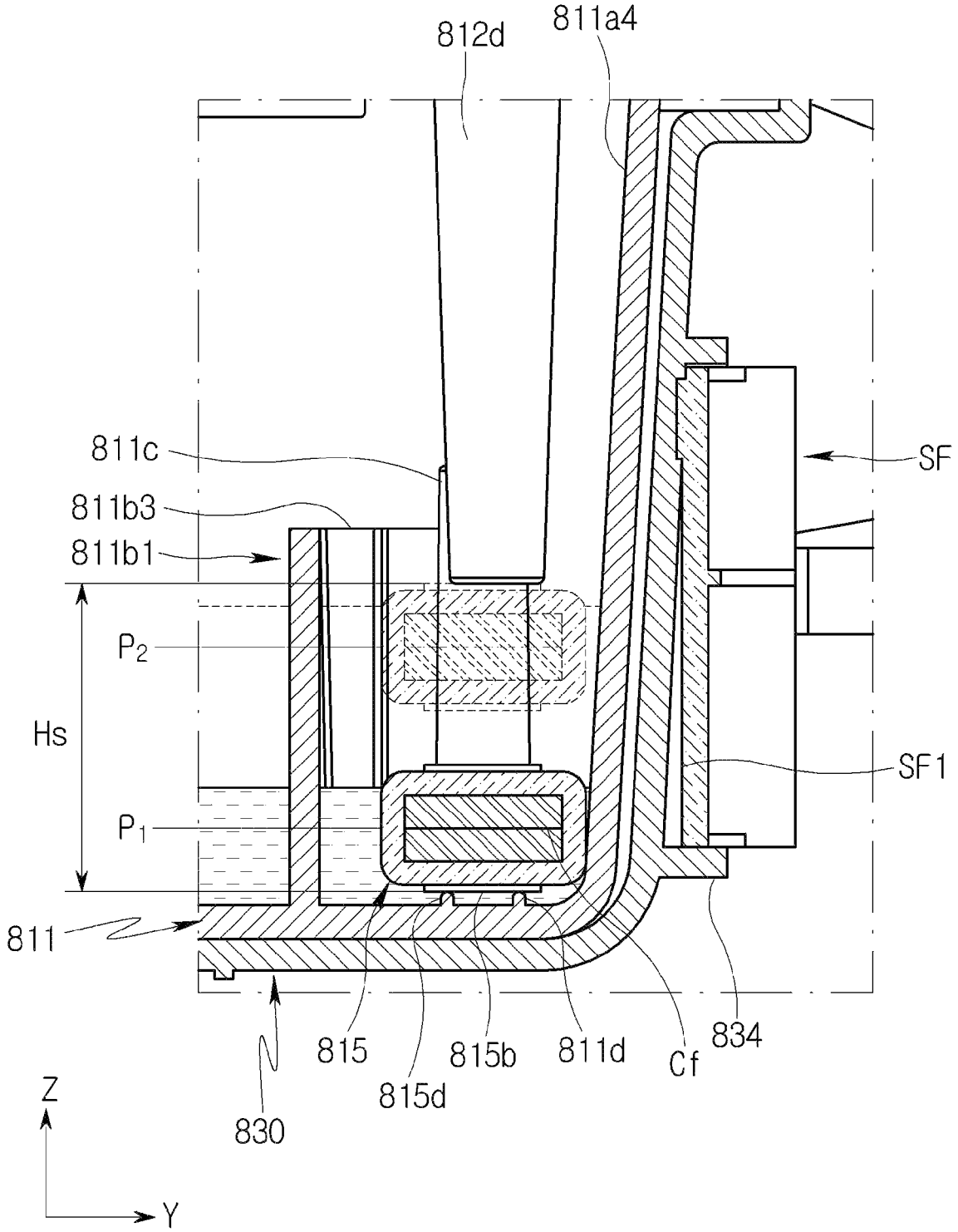

In more detail, as shown in FIGS. 5, 10 and 11, the floater case 811*b* may include a main plate 811*b*1 constituting U-shape, a first subplate 811*b*2, and a second subplate 811*b*3.

The main plate 811*b*1 may be formed toward one side of the tank body 811, preferably toward the second side surface 811*a*4 on which the floater 815 is installed, and configured to have a flat plate shape as a whole.

The first subplate 811*b*2 may be integrally formed at the front end of the main plate 811*b*1, formed toward the front surface 811*a*1 of the box-shaped tank body 811 and configured to have a flat plate shape as a whole.

The second subplate 811*b*3 may be integrally formed at the other rear end of the main plate 811*b*1, formed toward the rear surface 811*a*2 of the tank body 811 and configured to have a flat plate shape as a whole.

In this case, the main plate 811*b*1, the first subplate 811*b*2 and the second subplate 811*b*3 may be formed to have the same height from the lower side surface 811*a*5 of the tank body 811, respectively.

The floater 815 may be installed in the accommodation space defined by the second side surface of the tank body 811 and the U-shaped structure including the main plate 811*b*1, the first subplate 811*b*2 and the second subplate 811*b*3, and the influence of the floating of the water surface in the outer space of the floater case 811*b* can be minimized, and the vertical movement of the floater 815 cannot be disturbed.

On the other hand, the floater case 811*b* may be spaced apart from the second side surface 811*a*4 of the tank body 811 at a predetermined interval, so that the accommodation space defined by the floater case 811*b* and the second side surface 811*a*4 of the tank body 811 can communicate with the outer space of the floater case 811*b*.

In addition, a plurality of reinforcing ribs 811*b*4 extending linearly in the vertical direction (Z direction) may be formed on the inner surfaces of the main plate 811*b*1, the first subplate 811*b*2 and the second subplate 811*b*3 facing the floater 815, so that the frictional force can be reduced by minimizing each contact area with the floater 815, while reinforcing the rigidity of the floater case 811*b*.

In addition, a plurality of the bottom ribs 811*d* may be further installed on the lower side surface 811*a*5 of the tank body 811 inside the accommodation space defined by the floater case 811*b* and the second side surface 811*a*4 of the tank body 811, so that the contact area with the floater 815 can be minimized and the lowermost position of the floater 815 can be defined.

As described above, the plurality of bottom ribs 811*d* may be each configured to have a linear shape, and extend in a direction intersecting with the outer ribs 815*b* so that the contact area with the outer ribs 815*b* may be minimized.

The highest position P2 of the floater 815 based on the center position Cf of the magnet M can be defined by the stopper 812*d* formed on the tank cover 812 to be described later.

On the other hand, the guide bar 811*c* may guide the movement of the floater 815 together with the floater case 811*b*, and, like the floater case 811*b*, be integrally injection molded with the main body portion 811*a* of the tank body 811.

Specifically, as shown, the guide bar 811*c* may be configured as a pair of pillars, preferably cylinders, extending upwardly (Z direction) from the lower side surface 811*a*5 of the tank body 811.

The guide bar 811*c* composed of a pair of cylinders may be inserted into a pair of the first through hole 815*h*1 and the second through hole 815*h*2 formed in the floater 815 to guide the movement of the floater 815 and to prevent the departure of the floater 815.

The stopper 812*d* for setting the maximum height of the floater 815 or the magnet M may be integrally formed on the lower side surface 812*a*4 of the flat plate 812*a* of the tank cover 812.

As shown in FIGS. 10 and 11, the stopper 812*d* may be configured in a columnar shape having one end fixed to the lower side surface 812*a*4 of the flat plate 812*a* of the tank cover 812, and the other end protruding and extending toward the upper side surface of the floater 815, i.e., the first outer surface 815*a*1, and integrally formed and manufactured during the injection molding of the flat plate 812*a* of the tank cover 812.

On the other hand, as shown in FIG. 11, the height Hs from the lower side surface 811*a*5 of the tank body 811 to the other end of the stopper 812*d* may be need to set shorter than the height from the lower side surface 811*a*5 of the tank body 811 to the height at which the pair of guide bars 811*c* protrudes, or the protruding height of the above-described floater case 811*b*.

That is, as described above, the floater 815 can be guided to move in the vertical direction along a pair of guide bars 811*c*, if the height Hs from the lower side surface 811*a*5 of the tank body 811 to the other end of the stopper 812*d* is higher or lower than the height at which the pair of guide bars 811*c* protrude, the possibility that the floater 815 may be separated from the guide bar 811*c* in the process of replenishing water into the tank body 811 may increase.

By setting the height Hs from the lower side surface 811*a*5 of the tank body 811 to the other end of the stopper 812*d* in this way, when the floater 815 rises from the lowest position P1, as shown in FIG. 11, and reaches the highest position P2 that comes into contact with the other end of the stopper 812*d*, the separation of the floater 815 from the pair of guide bars 811*c* can be effectively prevented even when various external forces such as shock or vibration are applied.

As such, it will be appreciated that the technical configuration of the present invention described above can be implemented in other specific forms without changing the technical spirit or essential features of the present invention by those skilled in the art.

Therefore, the embodiments described above are to be understood as illustrative and non-limiting in all respects, and the scope of the present invention is indicated by the claims to be described later rather than the detailed description described above, and the meaning and scope of the claims and all changes or modified forms derived from the equivalent concept should be interpreted as being included in the scope of the present invention.

Explanation of reference numerals

| | |
|---|---|
| 1: laundry dryer | 20: drum |
| 30: duct unit | 40: heat exchange unit |
| 50: driving unit | 60: water collecting unit |
| 70: water storage unit | 80: water supply unit |
| 81: internal water supply unit | 810: storage tank |
| 811: tank body | 812: tank cover |
| 813: decorative cover | 816: handle unit |
| 815: floater | M: magnet |
| SF: floater sensor | 820: supply pump |
| 830: tank housing | 90: steam unit |
| 100: steam control unit | |

What is claimed is:

1. A laundry dryer comprising:

a cabinet defining an outer body of the laundry dryer;

a drum that is rotatably disposed inside the cabinet and that is configured to receive hot air and steam;

a steam unit that is disposed inside the cabinet and that is configured to generate the steam;

a storage tank that is configured to detachably couple to an inside of the cabinet and that is configured to receive water to be supplied to the steam unit;

a tank housing that is disposed inside the cabinet and that is configured to accommodate the storage tank; and a floater that is placed inside the storage tank and that is configured to move in a vertical direction according to a volume of water in the storage tank, wherein the floater includes a body portion having (i) a first outer surface and a second outer surface that are parallel to each other and are spaced apart at a first interval, (ii) a third outer surface and a fourth outer surface that are parallel to each other and are spaced apart at a second interval, and (iii) a fifth outer surface and a sixth outer surface that are parallel to each other and are spaced apart at a third interval, wherein the first outer surface defines an upper surface of the floater in the vertical direction and the second outer surface defines a lower surface of the floater in the vertical direction, and wherein the first interval is less than the second interval or the third interval.

2. The laundry dryer of claim 1, wherein the third interval is 8 to 10 times greater than the first interval.

3. The laundry dryer of claim 1, wherein the second interval is 1.5 to 2.5 times greater than the first interval.

4. The laundry dryer of claim 1, wherein the floater further includes a magnet that has a hexahedral shape and that is embedded in the body portion, and wherein the body portion includes a magnet receiving unit in which the magnet is inserted and that a shape corresponding to the shape of the magnet.

5. The laundry dryer of claim 4, wherein a height of the magnet in the vertical direction is 0.5 to 0.8 times the first interval.

6. The laundry dryer of claim 4, wherein the floater further includes a pair of through holes each extending from the first outer surface to the second outer surface in the vertical direction.

7. The laundry dryer of claim 6, wherein the magnet is disposed between the pair of through holes.

8. The laundry dryer of claim 7, wherein the pair of through holes includes (i) a first through hole defined adjacent to the fifth outer surface and (ii) a second through hole defined adjacent to the sixth outer surface, and wherein a distance from a center of the first through hole to the magnet and a distance from a center of the second through hole to the magnet are equal to each other.

9. The laundry dryer of claim 8, wherein a distance from the fifth outer surface to the center of the first through hole and a distance from the sixth outer surface to the center of the second through hole are equal to each other.

10. The laundry dryer of claim 6, wherein the floater further includes a plurality of internal ribs that protrude from an inner circumferential surface of each of the pair of through holes and that extends in a direction from the first outer surface toward the second outer surface.

11. The laundry dryer of claim 10, wherein each of the plurality of internal ribs has the same shape and is spaced apart at a same interval.

12. The laundry dryer of claim 11, wherein the storage tank includes:

a box-shaped tank body that defines an opening at an upper side and that defines a storage space for receiving the water; and a tank cover coupled to the upper side of the box-shaped tank body, and wherein the box-shaped tank body includes a pair of guide bars that protrudes from a lower surface of the box-shaped tank body and that extends in the vertical direction through each of the pair of through holes.

13. The laundry dryer of claim 12, wherein the box-shaped tank body further includes a floater case protruding from the lower surface of the box-shaped tank body to surround three sides of the floater.

14. The laundry dryer of claim 13, wherein the floater case includes:

a main plate provided toward a first surface of the box-shaped tank body;

a first subplate that is integrally provided at a front end of the main plate and that extends in parallel to a front surface of the box-shaped tank body; and a second subplate that is integrally provided at a rear end of the main plate and that extends in parallel to a rear surface of the box-shaped tank body, wherein the main plate, the first subplate, the second subplate, and the first surface of the box-shaped tank body define an accommodation space in which the floater moves in the vertical direction.

15. The laundry dryer of claim 14, wherein the first subplate and the second subplate are respectively spaced apart from the first surface of the box-shaped tank body at a predetermined interval.

16. The laundry dryer of claim 14, wherein the box-shaped tank body further includes a plurality of bottom ribs that extends in a direction parallel to the lower surface of the box-shaped tank body and that protrudes from the lower surface of the box-shaped tank body.

17. The laundry dryer of claim 16, wherein the floater further includes a plurality of outer ribs that extends in a direction parallel to the first outer surface and the second outer surface, respectively, and that protrudes from the first and second outer surfaces, respectively, and wherein the plurality of outer ribs extends in a direction intersecting a direction in which the plurality of bottom ribs extends.

18. The laundry dryer of claim 14, wherein the tank cover includes a stopper that has columnar shape and that has a first end fixed to the lower surface of the tank cover and a second end extending toward the first outer surface of the floater, and wherein the floater is configured to, based on the second end of the stopper contacting the first outer surface, stop moving in the vertical direction.

19. The laundry dryer of claim 18, wherein a height from the lower surface of the box-shaped tank body to the second end of the stopper is shorter than a height at which the pair of guide bars protrudes from the lower surface of the box-shaped tank body.

20. The laundry dryer of claim 19, wherein the main plate, the first subplate, and the second subplate protrude to the same height from the lower surface of the box-shaped tank body, and wherein the height from the lower surface of the box-shaped tank body to the second end of the stopper is shorter than a height of the main plate, the first subplate, or the second subplate.

21. The laundry dryer of claim 18, wherein a height from the lower surface of the box-shaped tank body to the second end of the stopper is 2.5 to 3.5 times greater than the first interval.

22. The laundry dryer of claim 4, further comprising a floater sensor that is disposed in the tank housing and that is configured to detect a vertical position of the magnet embedded in the floater, wherein the floater sensor includes a sensing unit extending in the vertical direction between a lowest position and a highest position of the magnet.

23. The laundry dryer of claim 22, wherein the floater sensor is disposed at an outer surface of the tank housing, and the sensing unit is disposed at a position on the outer surface of the tank housing adjacent to the magnet.

* * * * *